United States Patent [19]

Nixon

[11] Patent Number: 4,808,960

[45] Date of Patent: Feb. 28, 1989

[54] THERMAL CUTOFF HEATER

[75] Inventor: Ronald A. Nixon, Mansfield, Ohio

[73] Assignee: Therm-O-Disc, Incorporated, Mansfield, Ohio

[21] Appl. No.: 118,016

[22] Filed: Nov. 6, 1987

[51] Int. Cl.[4] ..... H01H 85/00; H01H 61/02; H01H 37/76

[52] U.S. Cl. ..... 337/4; 337/102; 337/107; 337/408

[58] Field of Search ..... 337/401–409, 337/102–107, 4; 219/535, 511, 549, 517

[56] References Cited

U.S. PATENT DOCUMENTS

| | | | |
|---|---|---|---|
| 3,717,793 | 2/1973 | Peterson | 219/517 |
| 4,035,613 | 7/1977 | Sagawa et al. | 219/535 |
| 4,121,093 | 10/1978 | Wainwright | 219/535 |

*Primary Examiner*—H. Broome

*Attorney, Agent, or Firm*—Jones, Day, Reavis & Pogue

[57] ABSTRACT

A thermal cutoff having a metal foil resistance heater circuit bonded to its outer surface.

14 Claims, 2 Drawing Sheets

THERMAL CUTOFF HEATER

BACKGROUND OF THE INVENTION

This application pertains to the art of thermal cutoffs and, more particularly, to thermal cutoffs for protecting electric circuits. The invention is particularly applicable for use with thermal cutoffs of the type having a meltable thermal pellet, and will be described with specific reference thereto. However, it will be appreciated that the invention has broader aspects and can be used with other types of thermal cutoffs.

Application of a heat source to the outside of a thermal cutoff has long been recognized as a means of producing a time delay or a current sensitive fuse in conjunction with a thermally sensitive fuse. This has been done previously by wrapping a thermal cutoff body in dielectric tape, and placing a free standing resistance coil of fine wire over the tape. The realistic limit of resistance for this type of assembly is five ohms, because of the fragile nature of the fine wire coil. It would be desirable to provide a thermal cutoff with an external resistance heater having a substantially greater resistance than is possible with a fine wire coil.

SUMMARY OF THE INVENTION

A thermal cutoff is provided with an external resistance heater in the form of a metal foil resistance heater circuit. In a preferred arrangement, the resistance heater circuit has a resistance greater than 15 ohms.

In one arrangement, the metal foil resistance heater circuit is bonded to a flexible dielectric tape that in turn is adhered to the exterior of the thermal cutoff housing. The foil resistance heater circuit preferably extends in a generally zigzag path between the opposite sides of the tap along the length thereof.

The resistance heater circuit has a pair of leads adjacent one end of the tape, and extends over a length greater than the circumference of the thermal cutoff housing.

The tape is applied to the thermal cutoff housing with the tape sides extending transversely of the thermal cutoff longitudinal axis. Most preferably, the tape sides lie in planes extending substantially perpendicular to the thermal cutoff longitudinal axis.

The foil may comprise high resistance inconel, and have a thickness of about 0.0005 inch.

The assembled thermal cutoff and heater may be mounted on a bracket having four terminals. The thermal cutoff has a pair of leads connected to a pair of the terminals, and the resistance heater has a pair of leads connected to the other pair of terminals. The terminals may be aligned along a common axis, and include a pair of outer terminals and a pair of intermediate terminals. The thermal cutoff leads are connected to the outer pair of terminals, and the resistance heater leads are connected to the intermediate pair of terminals.

It is a principal object of the present invention to provide an improved thermal cutoff and resistance heater assembly.

It is also an object of the invention to provide a thermal cutoff with a highly efficient high resistance heater.

It is a further object of the invention to provide a thermal cutoff with a resistance heater that is economical to manufacture and simple to install.

DESCRIPTION OF A PREFERRED EMBODIMENT

Figure 1:
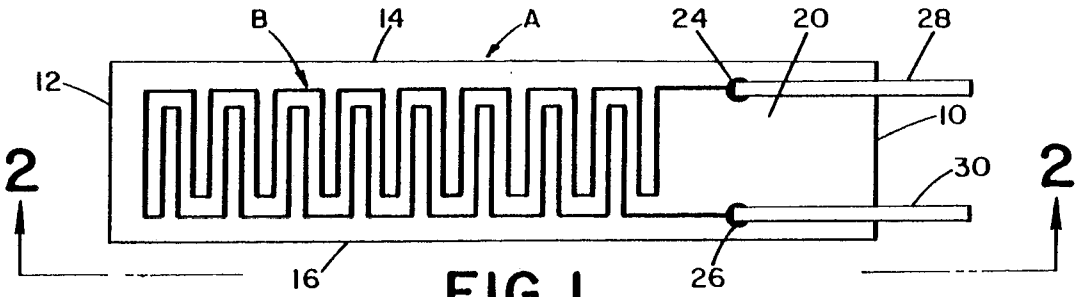
FIG. 1 is a top plan view of a foil resistance heater circuit used in the assembly of the present application.

Referring now to the drawing, wherein the showings are for purposes of illustrating a preferred embodiment of the invention only, and not for purposes of limiting same, FIG. 1 shows a flexible dielectric tape A having opposite ends 10, 12, and opposite sides 14, 16. Tape A may take many forms, and may be of a plastic material such as a polyamide.

A high resistance metal foil is bonded to one surface 20 of tape A. The foil may take many forms, and may be inconel having a thickness of about 0.0005 inch. The foil may be bonded to surface 20 with a thermosetting adhesive, such as a phenolic or epoxy-type of adhesive, under heat and pressure. A circuit is then printed on the foil, and the foil is chemically etched away to leave the printed resistance circuit B firmly bonded to surface 20 of tape A.

Metal foil high resistance heater circuit B extends in a generally zigzag path between opposite tape sides 14, 16, and is elongated in a direction between tape ends 10, 12. Resistance heater circuit B preferably has a resistance in excess of 15 ohms, and has a pair of circuit ends 24, 26 located adjacent tape end 10. A pair of connector leads 28, 30 are connected with circuit end portions 24, 26, and extend outwardly from tape end 10.

Figure 2:
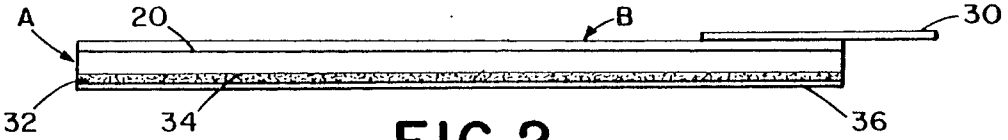
FIG. 2 is a side elevational view taken generally on line 2—2 of FIG. 1.

FIG. 2 shows a pressure-sensitive adhesive 32 on opposite surface 34 of tape A. Adhesive 32 is preferably a thermosetting adhesive, such as a phenolic, resorcinol or epoxy. A waxy release paper 36 removably covers the outer surface of adhesive layer 32.

Figure 3:
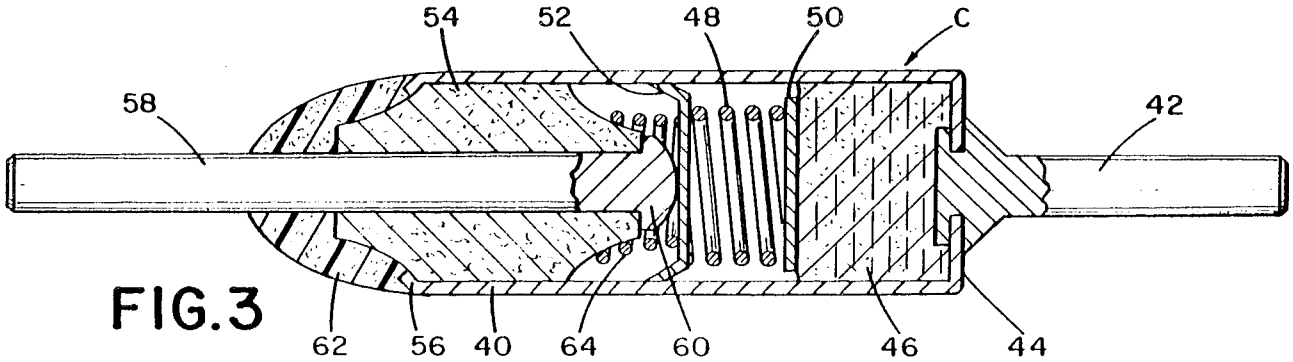
FIG. 3 is a cross-sectional elevational view of a typical thermal cutoff.

FIG. 3 shows a typical thermal cutoff C usable with the heater of FIGS. 1 and 2. A conductive generally cup-shaped metal housing 40 has a lead 42 attached to one end 44 thereof. Thermal means in the form of a meltable thermal pellet 46 is received in housing 40 adjacent end 44. Thermal pellet 46 may be an organic chemical, such as caffeine or animal protein. A coil spring 48 is compressed between a disc 50 and a slidable star contact 52. Star contact 52 has a plurality of circumferentially-spaced outwardly inclined resilient fingers that resiliently engage the interior of housing 40 in sliding conductive relationship therewith. A ceramic bushing 54 is retained within housing 40 by deforming end portion 56 inwardly. A lead 58 mounted in bushing 54 has a contact 60 thereon. Bushing 54 and lead 58 are covered by epoxy sealant 62. A coil spring 64 is compressed between bushing 54 and star contact 52 around lead contact 60.

In the position of FIG. 3, there is a conductive path from lead 42 to lead 58 through housing C to star contact 52, and then.to lead contact 60. When thermal pellet 46 reaches its predetermined melting temperature, coil spring 48 expands when pellet 46 becomes liquid, and the biasing force of spring 64 becomes greater than the biasing force of spring 48. This moves star contact 52 to the right in FIG. 3 away from lead contact 60 so there is no longer a conductive path from lead 42 to lead 58.

Figure 4:
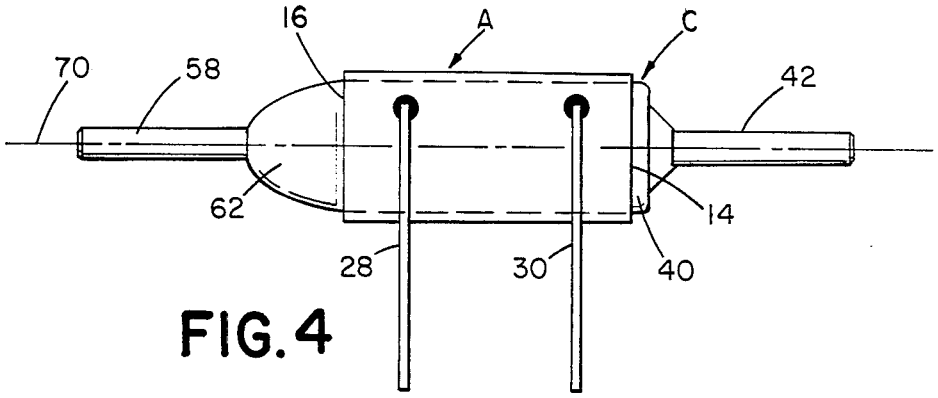
FIG. 4 is a side elevational view of a thermal cutoff having the heater of FIGS. 1 and 2 installed thereon.

FIG. 4 shows tape A with the resistance heater circuit thereon wrapped around housing 40 of thermal cutoff C. Release paper 36 is removed from adhesive layer 32 in FIG. 2, and adhesive 32 is applied against housing 40 while wrapping the tape around the thermal cutoff housing. The assembled heater and thermal cutoff are preferably baked at a temperature below the melting point of pellet 46 to cure the thermosetting adhesive, and intimately bond the high resistance heater circuit to the exterior f the thermal cutoff housing.

The width of tape A between its opposite sides 14, 16 is only slightly less than the length of housing 44. Also, tape sides 14, 16 extend transversely of thermal cutoff longitudinal axis 70 and, most preferably, lie in planes extending substantially perpendicular to axis 70. Housing 40 is cylindrical and has a predetermined circumference. The length of resistance heater circuit B in a direction between opposite tape ends 10, 12 is preferably greater than the predetermined circumference of housing 40 such that the opposite ends of the circuit overlap one another when the tape is wrapped around the housing.

Figure 5:
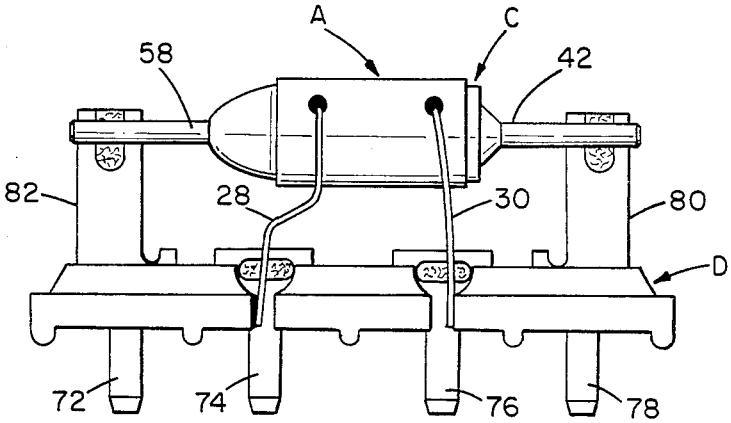
FIG. 5 is a side elevational view showing the assembled heaterand thermal cutoff of FIG. 4 mounted on a terminal bracket.

FIG. 5 shows a terminal bracket D having four terminals 72, 74, 76 and 78 that are aligned along a common axis. The terminals include a pair of opposite outer terminals 72, 78, and a pair of intermediate terminals 74, 76. End terminals 72, 78 have integral cutoff mounting legs 80, 82 extending upwardly from terminal bracket D. Thermal cutoff leads 42, 58 are welded to integral cutoff mounting legs 80, 82 on end terminals 72, 78. Resistance heater connector leads 28, 30 are welded to intermediate terminals 74, 76. The assembled bracket, thermal cutoff and resistance heater may be readily assembled to a circuit board or in any other circuit.

Figure 6:
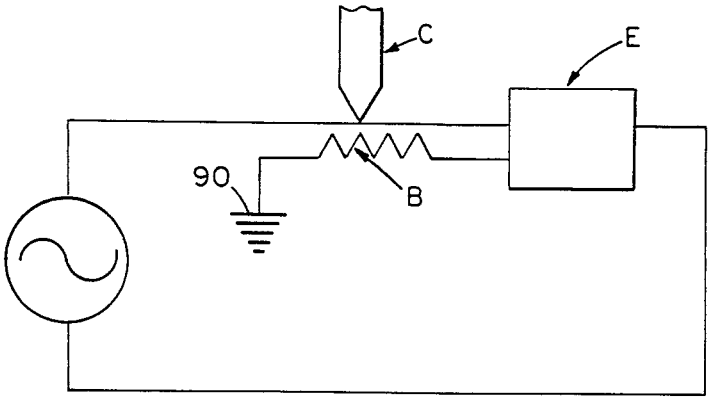
FIG. 6 is a schematic circuit showing generally how the assembled heater and thermal cutoff is used.

FIG. 6 shows thermal cutoff C connected in series with a load E. Resistance heater circuit B is connected with load E and to ground 90. In the event of a short in load E, a small current will flow through resistance heater circuit B for raising the temperature of thermal cutoff C to the melting temperature of the thermal means defined by meltable thermal pellet 46. The arrangement is such that once resistance heater circuit B is energized, thermal cutoff C will open the circuit in not more than 60 seconds, and preferably sooner. When the resistance heater circuit is energized, the device acts as a current sensitive fuse. The device also acts as a thermally sensitive fuse without energization of the resistance heater circuit. In the event of a malfunction that causes the load to give off excessive heat, the thermal pellet will melt and open the circuit without receiving any heat from the resistance heater circuit.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A conductive thermal cutoff including a housing containing thermal means for interrupting current flow through said cutoff responsive to a predetermined temperature, resistance heater means on said housing for heating said thermal means, said resistance heater means comprising a high resistance metal foil resistance heater circuit bonded to one surface of a flexible dielectric tape having its opposite surface adhered to said housing.

2. The cutoff of claim 1 wherein said tape has its opposite surface adhered to said housing with a baked thermosetting adhesive.

3. The cutoff of claim 1 wherein said tape has opposite sides and opposite ends, and a pair of resistance connector leads connected with said resistance circuit adjacent one of said tape ends.

4. The cutoff of claim 3 wherein said resistance circuit comprises a conductive foil that extends back and forth between said tape sides in a generally zigzag path that starts and ends adjacent one of said tape ends.

5. The cutoff of claim 4 wherein said cutoff housing is substantially cylindrical and has a longitudinal axis, and said tape is wrapped around said housing with said tape sides extending transversely of said axis.

6. The cutoff of claim 5 wherein said tape sides lie in planes extending substantially perpendicular to said axis.

7. The cutoff of claim 1 including a terminal bracket having at leadt three terminals therein, said cutoff having a pair of cutoff leads, said cutoff leads being welded to one pair of said terminals and said resistance connector leads being welded to another pair of said terminals.

8. The cutoff of claim 7 wherein said terminals are aligned along a common axis and include a pair of opposite outer terminals and a pair of intermediate terminals, said cutoff leads being welded to said pair of outer terminals and said resistance connector leads being welded to said pair of intermediate terminals.

9. The cutoff of claim 1 wherein said foil comprises inconel.

10. The cutoff of claim wherein said resistance circuit has a resistance greater than 15 ohms.

11. The cutoff of claim 1 wherein said foil has a thickness of about 0.0005 inch.

12. A thermal cutoff including a conductive metal housing, said cutoff having an electrically conductive path therethrough which includes said conductive housing, said cutoff including thermal means for interrupting current flow through said electrically conductive path responsive to a predetermined temperature, a dielectric tape bonded to said housing, and a metal foil resistance heater circuit bonded to said tape on the opposite side thereof from said housing.

13. The cutoff of claim 12 wherein said resistance heater circuit has a resistance greater than 15 ohms.

14. The cutoff of claim 12 wherein said tape has opposite ends and opposite sides, said resistance heater circuit extending in a generally zigzag path between said sides and extending over a predetermined length between said tape ends, said housing being substantially cylindrical and having a predetermined circumference, and said predetermined length of said resistance heater circuit being greater than said predetermined circumference.

* * * * *